US006202801B1

(12) United States Patent
Müller et al.

(10) Patent No.: US 6,202,801 B1
(45) Date of Patent: Mar. 20, 2001

(54) EQUIPMENT FOR CARRYING OUT OPERATIONS IN AN ELEVATOR SHAFT

(75) Inventors: Rolf Müller, Shizuoka (JP); Hanspeter Bloch, Buchrain (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 09/564,821

(22) Filed: May 4, 2000

(30) Foreign Application Priority Data

May 7, 1999 (EP) ..... 99810398

(51) Int. Cl.[7] ..... B66B 11/02; B66B 9/04

(52) U.S. Cl. ..... 187/401; 187/414; 187/269

(58) Field of Search ..... 187/240, 336, 187/337, 338, 339, 340, 341, 342, 401, 414, 269, 211, 213, 250, 379; 312/306, 312, 325

(56) References Cited

U.S. PATENT DOCUMENTS 1,406,942 * 2/1922 Dean ..... 187/350
3,704,799 * 12/1972 Morris, Jr. ..... 187/237
3,942,663 * 3/1976 Wentzel ..... 187/237
4,166,517 * 9/1979 Henderson ..... 187/261
4,415,066 * 11/1983 Mensik ..... 187/242
4,943,204 * 7/1990 Ehrlich ..... 187/211
5,979,606 * 11/1999 Wheeler ..... 187/269

FOREIGN PATENT DOCUMENTS 05097357 4/1993 (JP) .
405262475 * 10/1993 (JP) ..... 187/269
406156940 * 6/1994 (JP) ..... 187/269
09309677 12/1997 (JP) .

* cited by examiner

*Primary Examiner*—Dean J. Kramer
*Assistant Examiner*—Paul T. Chin
(74) *Attorney, Agent, or Firm*—MacMillan, Sobanski & Todd, LLC

(57) ABSTRACT

A maintenance trestle is stowable in folded-together form in the floor of an elevator car and has a platform forming the floor. The platform is steplessly adjustable in height between a stored position and an erected position by lifting equipment operating on the scissors principle. Buttons on a car panel that normally control car operations, such as opening and closing doors, can be converted to controlling the extension and retraction of the platform.

8 Claims, 1 Drawing Sheet

EQUIPMENT FOR CARRYING OUT OPERATIONS IN AN ELEVATOR SHAFT

BACKGROUND OF THE INVENTION

The present invention relates to equipment for carrying out operations in an elevator shaft, in which an elevator car with a maintenance trestle, from which the operations can be performed, is movable.

Equipment for the servicing of shaft equipment of an elevator installation is shown in the Japanese patent specification 05097357. A platform which is tiltable out of the car wall and serves as a standing surface for the engineer during servicing operations is provided in an elevator car. Provided in the roof of the elevator car is a hatch which is closable by means of a cover and which affords access to the shaft equipment. The engineer stands up on the platform and can carry out the operations in the shaft with his upper body protruding out of the car.

A disadvantage of the known equipment resides in the fact that the car wall supporting the platform has to be mechanically reinforced and in addition fittings for the tilting and fixing of the platform are necessary, at which the elevator users can be caught by articles of clothing or objects, because the platform is disposed in the standing region of the elevator users.

SUMMARY OF THE INVENTION

The present invention concerns an elevator car movable in an elevator shaft and including a plurality of side walls extending between a floor and a ceiling to form a car interior, the ceiling having a hatch formed therein closed by a movable hatch cover for access to an elevator shaft from the interior. A maintenance trestle folded and stored in the floor and has a platform for supporting a person, the platform forming the car floor in a stored position. When the maintenance trestle is unfolded, the platform is in an extended position in the car interior and a person standing on the platform in the extended position can reach through the hatch and carry out operations in the elevator shaft in which the elevator car travels. Lifting means are connected to the platform for steplessly adjusting the height of the platform between the stored position and the extended position. The lifting means can include scissors driven by a motor. An elevator control is connected to at least one button in the elevator car for controlling operation of the elevator car and switch means is connected to the elevator control and is responsive to an open position of the hatch cover for changing the at least one button to controlling the lifting means.

The present invention meets the object of avoiding the disadvantages of the known equipment and of creating equipment for operations in an elevator shaft, which equipment does not represent a risk either for the engineer or for the elevator users in the elevator car.

The advantages achieved by the invention are essentially that there is no risk for the elevator car users of injury on parts of the maintenance trestle, because the maintenance trestle is located outside the standing region of the elevator car users. Moreover, there are no attack points for vandalism such as, for example, edges, hinges, joints, etc., at the car walls. The car interior is not adversely affected by the maintenance trestle. In terms of selling strategy the aesthetic presentation of the car interior is of great economic significance. The maintenance trestle according to the invention completely and entirely meets this requirement, for example by the invisible arrangement of the maintenance trestle.

The maintenance trestle according to the invention also has an increased load-bearing capability, so that parts to be mounted or demounted in the shaft can be intermediately placed on the maintenance trestle. The position of the hatch or the ceiling opening in the roof of the elevator car can be so selected for the performance of operations in the elevator shaft that the hatch is not overlapped by shaft equipment arranged in the shaft head, wherein in this case the maintenance trestle lies in the projection of the hatch and moreover has a sufficiently large standing area. The position of the hatch, the sufficient standing area and the increased load-bearing capability of the maintenance trestle guarantee the safety of the engineer. Moreover, the maintenance trestle is extremely simple in operation and is quickly ready for use without effort.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
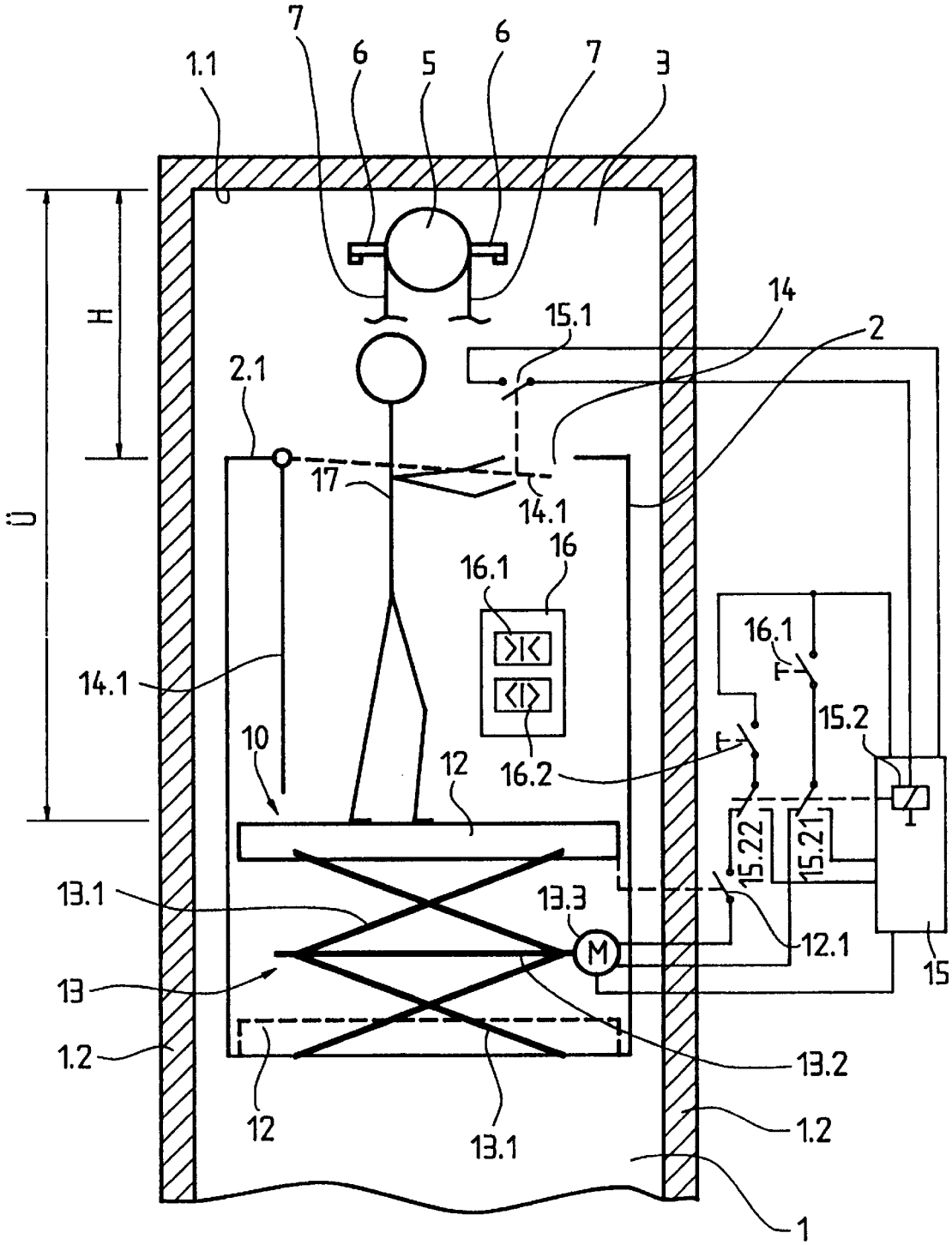
FIG. 1 is a schematic illustration of an elevator car that has a maintenance trestle according to the present invention, which car is stopped at the top stopping point in an elevator shaft with shortened shaft head.

An elevator shaft 1, in which an elevator car 2 is movable, is bounded by shaft walls 1.2. A drive pulley 5, which is connected with a drive that is not illustrated, is arranged in the shaft head 3. The drive pulley 5 and/or the drive is supported by, for example, a wall bracket 6 attached to one of the shaft walls 1.2. A carrying cable 7 has a cable course which is not illustrated, for example from a fixed point over a deflecting roller of the elevator car 2 or, in the case of a looping underneath, over two deflecting rollers, further over the drive pulley 5, further over a deflecting roller of a counterweight which is not illustrated and further to a further fixed point. The elevator car 2 includes a plurality of side walls extending between a ceiling 2.1 and a floor to form a car interior.

A maintenance trestle 10 is arranged in the elevator car 2 and serves for the maintenance of elevator equipment, such as, for example, the drive pulley 5, a drive, the support cable 7, guide rails, elevator switches, etc. A standing area from which the operations in the elevator shaft 1 are carried out is formed by a platform 12, which at the same time forms the floor of the elevator car 2. The platform 12 is adjustable in height by lifting equipment 13 operating on the scissors principle. For the transport of persons and goods, the platform 12 is in the stored position shown by dashed lines, in which the lifting equipment 13 is stowed under the platform forming the car floor. For maintenance operations on the elevator shaft 1, the platform 12 is steplessly adjustable in height up to the shown extended position.

The lifting equipment consists of a double scissors 13.1 that is drivable in the middle by means of a motorized spindle 13.2. In the illustrated example, a motor 13.3 is provided as spindle drive. Instead of the motor 13.3, a hand crank can also serve as spindle drive. The lifting equipment 13 can also be driven pneumatically or hydraulically, for example on the piston-cylinder principle.

A hatch 14, which is closable by means of a hatch cover 14.1, is provided in the roof or ceiling 2.1 of the elevator car 2. As shown in the FIG. 1, the hatch cover 14.1 is tiltable, but it can also be constructed to be removable.

The position of the hatch cover 14.1 is monitored by an elevator control 15 through a connection to a first limit switch 15.1. As soon as the hatch cover 14.1 is opened, as shown in the FIG. 1 by a dashed line, the elevator drive is converted from normal operation to maintenance operation by, for example, a relay 15.2 in the elevator control 15. The relay 15.2 is actuable by the first limit switch 15.1 to change the functions of two buttons of a car control panel 16. In the case of normal operation, a first button 16.1 has the function of a manual door closer and a second button 16.2 has the function of a manual door opener, wherein a floor door and a car door are closable or can be opened by means of the elevator control 15 and a door drive. In the case of maintenance operation, two contacts 15.21 and 15.22 of the relay 15.2 are in the illustrated setting, in which drive of the motor 13.3 is directly controllable by the buttons 16.1 and 16.2 in a downward direction or in an upward direction. The travel of the platform 12 in the upward direction is limited by a second limit switch 12.1 that is open in the illustrated position of the platform 12 and interrupts the current circuit for the upward movement. As a variant, the UP/DOWN button for the height adjustment of the platform 12 can be, for example, integrated into a closable car control panel to be invisible and to be accessible only for the engineer 17.

The position and the size of the hatch 14 are so selected that the hatch is not overlapped by shaft equipment, such as, for example, by the drive, arranged in the shaft head 3. The shown elevator configuration, without a machine room, offers, by its shortened shaft head 3, for the maintenance of the car roof an insufficient height H for a prescribed over-travel (distance between the car ceiling 2.1 and a shaft ceiling 1.1) of, for example, one meter. With the maintenance trestle 10 according to the invention in the shown extended position, the safety of an engineer 17 is taken care of and the required over-travel Ü achieved, because the distance between the car ceiling 2.1 and the shaft ceiling 1.1 is no longer determinative, but rather the distance between the platform 12 and the shaft ceiling 1.1, and because no shaft equipment in the shaft head 3 overlaps the hatch 14.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. Equipment for carrying out operations in an elevator shaft in which an elevator car is movable, the car including side walls extending between a floor and a ceiling forming a car interior, the ceiling having a hatch therein for accessing the elevator shaft from the car interior, comprising: a maintenance trestle having a platform for supporting a person in an elevator car in an extended position, said maintenance trestle being foldable for storage in a bottom of the elevator car with said platform forming a floor of the elevator car, said maintenance trestle unfolding to the extended position in the car interior from which a person standing on said platform can reach through the hatch in the car ceiling and carry out operations in an elevator shaft in which the elevator car travels.

2. The equipment according to claim 1 wherein said platform is selectively adjustable in height between the stored position and the extended position.

3. The equipment according to claim 1 including lifting means connected to said platform for steplessly adjusting the height of said platform between the stored position and the extended position.

4. The equipment according to claim 3 wherein said lifting means includes scissors driven by a motor.

5. An elevator car movable in an elevator shaft, comprising:

a plurality of side walls extending between a floor and a ceiling to form a car interior, said ceiling having a hatch formed therein closed by a movable hatch cover for access to an elevator shaft from the interior; and a maintenance trestle folded and stored in said floor and having a platform for supporting a person, said platform forming said floor in a stored position and when said maintenance trestle is unfolded, said platform is in an extended position in said car interior and a person standing on said platform in the extended position can reach through said hatch and carry out operations in the elevator shaft in which the elevator car travels.

6. The elevator car according to claim 5 including lifting means connected to said platform for steplessly adjusting the height of said platform between the stored position and the extended position.

7. The elevator car according to claim 6 including an elevator control connected to at least one button in the elevator car for controlling operation of the elevator car and switch means connected to said elevator control and responsive to an open position of the hatch cover for changing said at least one button to controlling said lifting means.

8. The elevator car according to claim 6 wherein said lifting means includes scissors driven by a motor.

* * * * *